US006796299B2

(12) United States Patent
Isono

(10) Patent No.: US 6,796,299 B2
(45) Date of Patent: Sep. 28, 2004

(54) IGNITION SYSTEM FOR INTERNAL COMBUSTION ENGINE AND IGNITION METHOD OF FUEL CHARGED IN A FUEL CHAMBER

(76) Inventor: Yasuo Isono, 1091-3-B-103 Kumagawa, Fussa-shi, Tokyo (JP), 197-0003

( * ) Notice: Subject to any disclaimer, the term of this patent is extended or adjusted under 35 U.S.C. 154(b) by 0 days.

(21) Appl. No.: 10/475,082

(22) PCT Filed: Apr. 12, 2002

(86) PCT No.: PCT/JP02/03694

§ 371 (c)(1),
(2), (4) Date: Oct. 23, 2003

(87) PCT Pub. No.: WO02/089277

PCT Pub. Date: Nov. 7, 2002

(65) Prior Publication Data

US 2004/0112351 A1 Jun. 17, 2004

(30) Foreign Application Priority Data

Apr. 25, 2001 (JP) ..... 2001-127897

(51) Int. Cl.[7] ..... F02P 13/00; H01T 13/20

(52) U.S. Cl. ..... 123/627; 123/169 EL; 313/141

(58) Field of Search ..... 123/627, 169 EL, 123/149 A, 169 MG, 169 EA, 163; 313/140–143

(56) References Cited

U.S. PATENT DOCUMENTS 4,487,177 A * 12/1984 Ishikawa ..... 123/260
4,851,732 A * 7/1989 Kashiwara et al. ..... 313/141
5,007,389 A * 4/1991 Kashiwara et al. .. 123/169 MG
5,502,352 A * 3/1996 Katoh et al. ..... 313/141
5,797,383 A * 8/1998 Matsubara et al. ..... 123/594
5,873,338 A * 2/1999 Matsubara et al. ... 123/169 EL
6,064,143 A * 5/2000 Kagawa ..... 313/141
6,095,124 A * 8/2000 Matsubara et al. ..... 123/594
6,225,752 B1 * 5/2001 Matsubara et al. .... 315/209 M
6,344,707 B1 * 2/2002 Kibbey ..... 313/141
6,495,948 B1 * 12/2002 Garrett, III ..... 313/141
6,611,084 B2 * 8/2003 Teramura et al. ..... 313/141
6,659,081 B2 * 12/2003 Asano et al. ..... 123/406.4
6,724,132 B2 * 4/2004 Kanao ..... 313/141

FOREIGN PATENT DOCUMENTS

| | | | |
|---|---|---|---|
| GB | 2 269 422 | 2/1994 | |
| JP | 2001 050147 | 2/2001 | |
| JP | 2001 082306 | 3/2001 | |
| JP | 324649 | * 11/2002 | ..... F02P/13/00 |
| RU | 2 077 099 | 4/1997 | |

* cited by examiner

*Primary Examiner*—Hai Huynh
(74) *Attorney, Agent, or Firm*—Oblon, Spivak, McClelland, Maier & Neustadt, P.C.

(57) ABSTRACT

A grounding electrode 20 is electrically grounds, and a center electrode 10 to which high voltage pulse is applied that an end of the grounding electrode 20 and an end of the center electrode 10 are disposed closely. The grounding electrode 20 is branched into a main grounding electrode 21 and an auxiliary grounding electrode 30. An end 25 of the main grounding electrode 21 and an end 36 of the auxiliary grounding electrode 30 are disposed close to an end 11 of the center electrode. An inductor section 32 that counterelectromotive force is generated according to a variation amount of flowing current is integrally provided between a portion of the auxiliary grounding electrode 30 branched from the grounding electrode 20 and the end 36 of the auxiliary grounding electrode 30.

8 Claims, 5 Drawing Sheets

IGNITION SYSTEM FOR INTERNAL COMBUSTION ENGINE AND IGNITION METHOD OF FUEL CHARGED IN A FUEL CHAMBER

TECHNICAL FIELD

The present invention relates to an ignition system of an internal combustion engine, which ignites mixture gas of air and fuel such as gasoline by discharge spark and converts combustion pressure into power, and the invention relates to an ignition method of fuel charged in a fuel chamber.

BACKGROUND ART

As means for igniting mixture gas of air and fuel in an internal combustion engine, one which applies high voltage pulse between two electrodes and ignites the mixture gas by generated discharge spark, is frequently used.

When discharge duration of the discharge spark used for ignition and magnitude of the discharge spark are sufficient, gas molecule of the mixture gas is excited by discharge immediately after the start of discharge. Further, the gas molecule of ionized mixture gas is accelerated by electric field by discharge and collides against gas molecule of another mixture gas, which generates a plurality of ionized molecule. Therefore, the ionized molecule is exponentially increased. If the gas molecule of mixture gas is ionized in this manner, the combustion speed after ignition is increased, and combustion efficiency is enhanced.

This ignition method, however, has characteristics that airflow between the two electrode wanders, or discharge-start voltage is largely varied by existence of impurity particle. Therefore, magnitude of discharge spark and discharge duration are varied, which largely affects ignition performance of fuel, combustion state and combustion efficiency. Especially since the internal combustion engine is cold immediately after actuation thereof, combustion is not stabilized, which largely affects magnitude of discharge spark and discharge duration.

If the magnitude of discharge spark and discharge duration are varied, the number of gas molecules of mixture gas which is excited is not stabilized. Hence, the combustion speed is decreased, combustion efficiency is deteriorated, which causes an accidental fire, deteriorates fuel consumption ratio of fuel due to incomplete combustion, lowers engine output, or increases hydrocarbon compounds in exhaust gas.

Especially in a low load driving state and in a lean burn vehicle engine, output of the engine is largely lowered and thus, various ignition systems have conventionally been proposed to enhance the combustion state in the combustion chamber.

As an ignition system for the internal combustion engine which enhances the ignition performance of fuel, there are a multi-point ignition type spark ignition system and a continuous ignition type spark ignition system. Japanese Patent Application Laid-open No. 2001-82306 proposes one multi-point ignition type spark ignition system. Japanese Patent Application Laid-open No. 2001-50147 proposes one continuous ignition type ignition system.

The multi-point ignition type ignition system proposed by Japanese Patent Application Laid-open No. 2001-82306 is a system that a piston or a combustion chamber is provided at the portion of its wall surface with ceramic material which is an insulation member, a plurality of electrodes are disposed on the ceramic material. Therefore, the ignition point is increased, and mixture gas is ignited.

The continuous ignition type ignition system proposed in Japanese Patent Application Laid-open No. 2001-50147 is an ignition system that energization and de-energization of primary current to be sent to an ignition coil are repeatedly controlled to allow the spark plug to carry out a plurality of discharges.

According to the ignition system of the multi-point ignition type spark, however, since machinability of combustion chamber and piston is complicated and difficult, applicable internal combustion engine is limited. Further, when the electrode is deteriorated with time over long term usage of the internal combustion engine, it is necessary to replace the piston and combustion chamber. Therefore, there are problems that operability of replacement and repair is inferior, and operation cost is expensive.

Further, according to the continuous ignition type ignition system, since the ignition control circuit is necessary, there are problems that the ignition system becomes complicated. When the parts are replaced or repaired, the entire ignition control circuit must be replaced, which increases the costs.

DISCLOSURE OF THE INVENTION

It is an object of the present invention to provide an ignition system for an internal combustion engine which can be easily produced, which has excellent operability at the time of replacement and repair and which does not require high operation costs, and to provide an ignition method of fuel charged in a fuel chamber.

A first aspect of the present invention provides an ignition system for an internal combustion engine comprising a grounding electrode which is electrically grounded, a center electrode to which high voltage pulse is applied, a main grounding electrode provided in the grounding electrode, an auxiliary grounding electrode provided in the grounding electrode, and an inductor section provided in the auxiliary grounding electrode, wherein an end of the main grounding electrode and an end of the auxiliary grounding electrode are disposed close to the end of the center electrode, and wherein the inductor section is integrally provided between a portion branched from the grounding electrode and the end of the auxiliary grounding electrode.

Since the auxiliary grounding electrode includes a function of an inductor, if high voltage pulse is applied to the electrode and the auxiliary grounding electrode is allowed to carry out the auxiliary discharge, the counterelectromotive force is generated in the inductor section of the auxiliary grounding electrode. Thus, the auxiliary discharge is completed in a short time. The mixture gas in the combustion chamber is not ignited, but the gas molecule of mixture gas can be excited. There is an effect that main discharge by the main grounding electrode ignites the gas molecule of excited mixture gas, ignition is reliably carried out, and the combustion efficiency is enhanced.

According to a second aspect of the invention, in the ignition system for the internal combustion engine of the first aspect, wherein the auxiliary grounding electrode is a bar-like bent portion that the inductor section is provided between the end of the auxiliary grounding electrode and the grounding electrode.

It is possible to set the reactance of the inductor section to an appropriate value, the discharge state of the auxiliary discharge is varied, and it is possible to further enhance the combustion efficiency.

According to a third aspect of the invention, in the ignition system for the internal combustion engine of the first aspect, wherein the inductor section is a helical bent portion.

It is possible to set the reactance of the inductor section to an appropriate value, the discharge state of the auxiliary discharge is varied, and it is possible to further enhance the combustion efficiency.

According to a fourth aspect of the invention, in the ignition system for the internal combustion engine of the first aspect, wherein the auxiliary grounding electrode is extended from the end of the main grounding electrode.

By disposing the auxiliary-grounding electrode on the end of the main grounding electrode, machinability of the electrode at the time of production thereof becomes easy.

According to a fifth aspect of the invention, in the ignition system for the internal combustion engine of the first aspect, wherein a distance between the auxiliary grounding electrode and the center electrode is narrower than a distance between the main grounding electrode and the center electrode.

Since the distance between the auxiliary grounding electrode and the center electrode is narrower than the distance between the main grounding electrode and the center electrode, there is effect that the auxiliary discharge can be carried out before the main discharge more reliably.

According to a sixth aspect of the invention, in the ignition system for the internal combustion engine of the first aspect, wherein for the single center electrode, the grounding electrode is branched into the single main grounding electrode and a plurality of auxiliary grounding electrodes.

Since the plurality of auxiliary grounding electrodes are provided for one main grounding electrode, the exciting state of the mixture gas molecule can further be enhanced.

According to a seventh aspect of the invention, in the ignition system for the internal combustion engine of the first aspect, the system further comprises a plurality of sets of opposed the grounding electrodes and the center electrodes.

Since the plurality of electrodes are provided, also for an internal combustion engine having a large combustion chamber, the mixture gas is brought into excited state by the auxiliary discharge, and all of the gas can be burned by the main discharge.

According to an eighth aspect of the present invention, there is provided an ignition method of fuel charged in a fuel chamber, comprising the steps of charging fuel and air into a combustion chamber, feeding high voltage pulse to a center electrode, carrying out auxiliary discharge between an auxiliary grounding electrode and the center electrode to excite mixture gas of fuel and air in the combustion chamber, and carrying out main discharge between a main grounding electrode and the center electrode to ignite the mixture gas.

The mixture gas molecule is excited by the auxiliary discharge, and mixture gas excited by the main discharge can be ignited. Therefore, the ignition is reliably carried out, and the combustion efficiency can be enhanced.

BEST MODE FOR CARRYING OUT THE INVENTION

Figure 1:
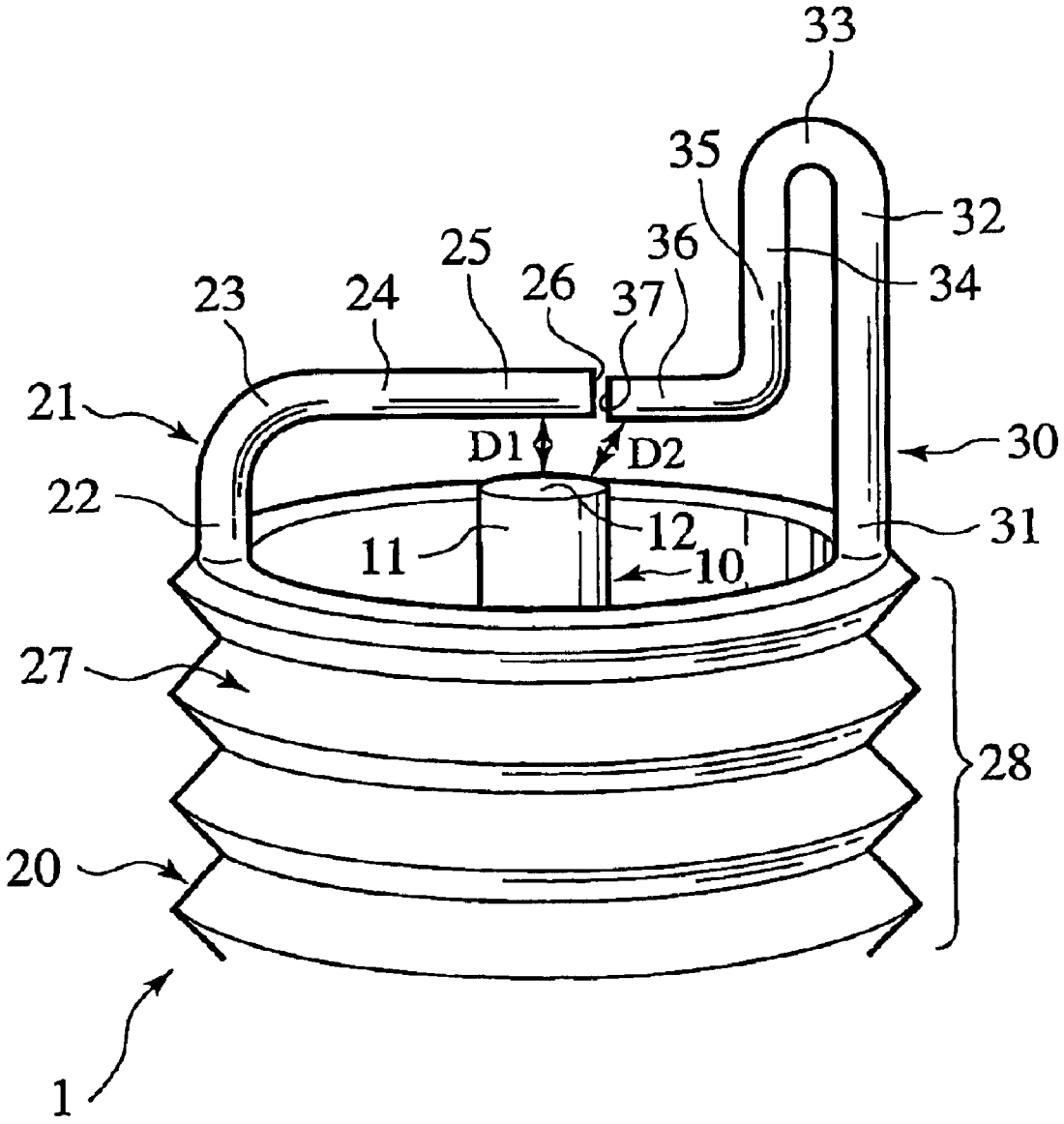
FIG. 1 is a diagram showing an electrode portion of a first embodiment when an ignition system for an internal combustion engine according to the present invention is applied to a spark plug.

Embodiments of the present invention will be explained below with reference to the drawings, wherein like numbers are designated by like reference characters.

As shown in FIG. 1, a grounding electrode 20 disposed in a spark plug of the first embodiment is formed into a cylindrical shape. The ground grounding electrode 20 comprises a grounding electrode base body 27 disposed in a spark plug body, a main grounding electrode 21 projecting from the grounding electrode base body 27, and an auxiliary grounding electrode 30 projecting from the grounding electrode base body 27. The grounding electrode base body 27 has a screw portion 28, and is screwed into a hole formed in a wall surface of a conductive combustion chamber so that the grounding electrode base body 27 is electrically grounded and fixes the spark plug.

The main grounding electrode 21 is integrally formed together with the grounding electrode base body 27 through a projection 22. A curvature of a bent portion 23 provided between the projection 22 and the straight portion 24. A length of the straight portion 24 are determined such that a distance between a tip end 25 of a straight portion 24 extending from the projection 22 and an end surface 12 of an end 11 of a center electrode 10 becomes D1.

The auxiliary grounding electrode 30 is integrally formed through a projection 31. Curvatures of bent portions 33 and 35 provided on an inductor section 32 and a length of a straight portion 34 between the bent portions 33 and 35 are determined such that a distance between a tip end 36 of the inductor section 32 extending from the projection 31 and an end surface of the end 11 of the later-described center electrode 10 becomes D2.

An end surface 26 of the main grounding electrode 21 and an end surface 37 of the auxiliary grounding electrode 30 are disposed closely. The main grounding electrode 21 and the auxiliary grounding electrode 30 are disposed such that the distance D2 between the center electrode 10 and the auxiliary grounding electrode 30 is narrower than the distance D1 between the center electrode 10 and the main grounding electrode 21.

The center electrode 10 is disposed on a substantially center axis of the cylindrical grounding electrode base body 27. The end 11 is disposed closer to the end 25 of the main grounding electrode 21 and an end 36 of the auxiliary grounding electrode 30. Secondary voltage is applied to the other end (not shown) of the center electrode 10 from an ignition coil through a terminal (not shown).

The auxiliary grounding electrode 30 includes the inductor section 32 which is bent at the bent portions 33 and 35 such that the projection 31 and the straight portion 34 are folded in parallel to each other between the end 36 of the auxiliary grounding electrode 30 and the projection 31. Therefore, the auxiliary grounding electrode 30 can exhibits function as inductor. Counterelectromotive force is generated so that magnetic flux generated when current flows inside the auxiliary grounding electrode 30 is canceled, and reactance is generated.

The cylindrical grounding electrode base body 27 and the center electrode 10 disposed on substantially the center axis of the grounding electrode base body 27 are electrically insulated from each other.

Figure 5A:
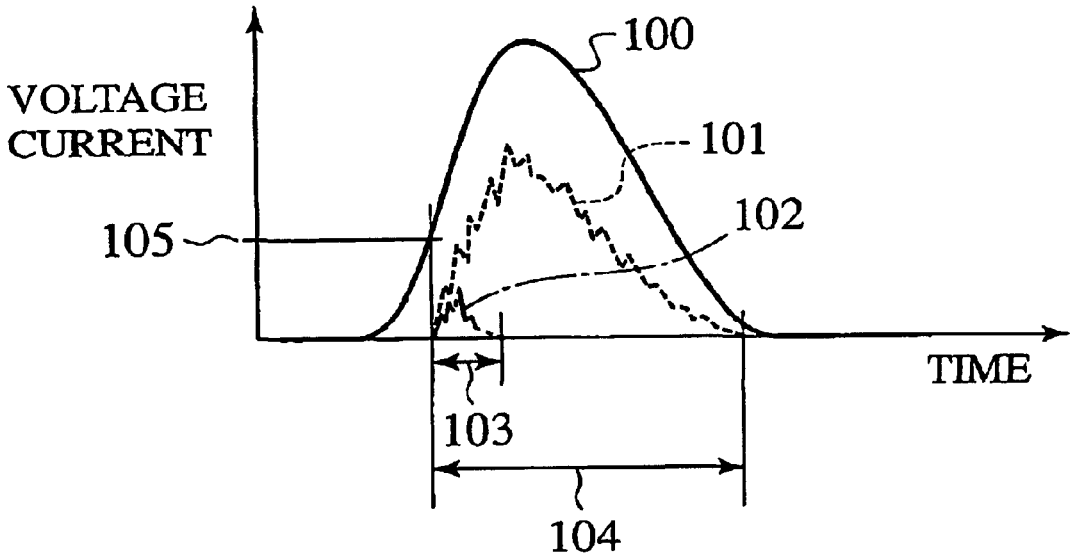
FIG. 5A shows variation with time of voltage applied between an center electrode and a grounding electrode when secondary voltage of ignition coil is applied to the spark plug that the first embodiment is applied to the present invention.
Figure 5B:
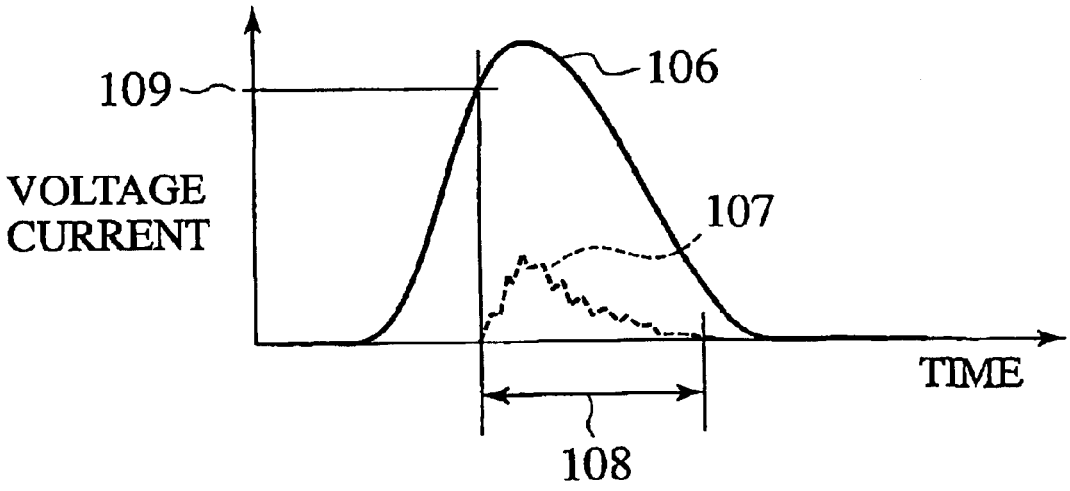
FIG. 5B shows variation with time of voltage applied between the center electrode and the grounding electrode and variation with time of discharge current flowing between the electrodes when secondary voltage of the ignition coil is applied the spark plug which is conventionally used and which does not have auxiliary grounding electrode.

FIG. 5A shows variation with time of voltage applied between an center electrode 10 and a grounding electrode 20 when secondary voltage of ignition coil is applied to the spark plug that the first embodiment is applied to the invention. A reference number 100 represents the secondary voltage of the ignition coil, a reference number 101 represents a main discharge current, a reference number 102 represents a auxiliary discharge current, a reference number 103 represents a auxiliary discharge time, a reference number 104 represents a main discharge time, and a reference number 105 represents a discharge-start voltage. FIG. 5B shows variation with time of voltage applied between the center electrode 10 and the grounding electrode 20 and variation with time of discharge current flowing between the electrodes when secondary voltage of the ignition coil is applied the spark plug which is conventionally used and which does not have auxiliary grounding electrode 30. A reference number 106 represents the secondary voltage of the ignition coil, a reference number 107 represents a discharge current, a reference number 108 represents a discharge time, and a reference number 109 represents the discharge-start voltage.

FIG. 5B shows that concerning voltage applied to the center electrode, if voltage between electrodes reaches the discharge-start voltage 109 of the spark plug, the discharge current 107 starts flowing between the center electrode and the grounding electrode, the voltage between electrodes is reduced and the discharge current is increased and decreased. In this conventional spark plug, since fluctuations of mixture gas between the electrodes or impurity particle exists, the actual discharge-start voltage is largely varied. Therefore, ignition performance of fuel, combustion state and combustion efficiency are largely affected. Especially immediately after actuation of internal combustion engine, since the combustion chamber is cold, combustion is unstable, and the magnitude of discharge spark and discharge duration are largely affected.

If the magnitude of discharge spark and discharge duration are varied, the number of gas molecules of excited mixture gas is unstable. Therefore, the combustion speed is decreased, the combustion efficiency is deteriorated, accidental fire is caused, fuel consumption ratio is deteriorated by incomplete combustion, output of engine is lowered, and hydrocarbon compounds in exhaust gas are increased.

In FIG. 5A, if secondary voltage 100 of the ignition coil is applied to a terminal of the spark plug, the secondary voltage 100 is applied between the opposed center electrode 10 and the grounding electrode 20. If the current flowing through the circuit is varied with angle frequency ω, impedance Z generated in the inductor section 32 having the reactance L is expressed by the following equation (1):

$$Z = i\,\omega L \quad (i\text{: imaginary unit}) \tag{1}$$

If voltage between electrodes reaches discharge-start voltage 105 of the spark plug, and discharge is started between the center electrode 10 and the auxiliary grounding electrode 30, most of the secondary voltage 100 is distributed to the auxiliary grounding electrode 30 by the impedance Z calculated by the equation (1). As a result, the auxiliary discharge between the center electrode 10 and the auxiliary grounding electrode 30 is completed in a short time because the rate of secondary voltage 100 distributed to the gap portion is decreased. With this, the auxiliary discharge between the electrodes of the auxiliary grounding electrode 30 and the center electrode 10 does not reach a value to ignite the mixture gas in the combustion chamber, but discharge energy which is sufficient to excite the gas molecule of mixture gas is emitted.

Since the main grounding electrode 21 does not have inductor section, reactance thereof is low, and distribution ratio of the secondary voltage 100 by the impedance is small. As a result, the main discharge between the main grounding electrode 21 and the center electrode is continued until the secondary voltage 100 becomes sufficiently small. That is, since the discharge duration becomes long and excited mixture gas molecule is ignited, the combustion state is stabilized, and combustion efficiency is also enhanced.

With this, there is effect that the accidental fire is prevented, fuel consumption rate is enhanced, engine output is enhanced, and hydrocarbon compounds in exhaust gas are reduced.

Figure 2:
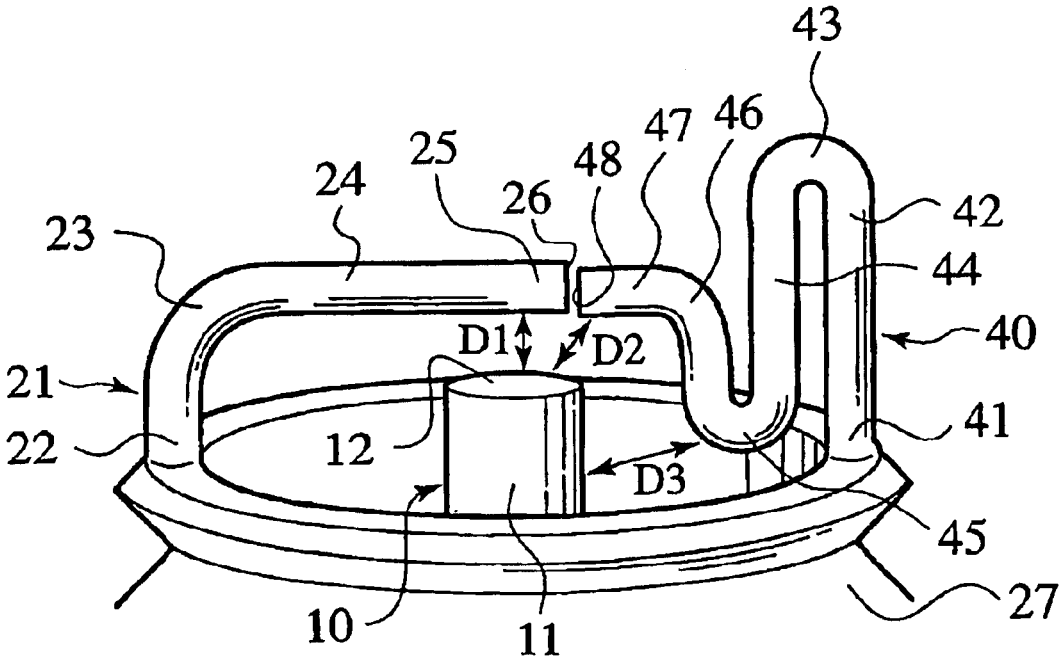
FIG. 2 is a diagram showing an electrode portion of a second embodiment when an ignition system for an internal combustion engine according to the present invention is applied to a spark plug.

A second embodiment shown in FIG. 2 is largely different from the first embodiment shown in FIG. 1 that the shape of the inductor section provided in the auxiliary grounding electrode is different.

According to a spark plug of the second embodiment, the number of bent portions of the auxiliary grounding electrode 40 is increased to three, i.e., bent portions 43, 45 and 46, so that the folded portion is increased from two to three, the reactance of an inductor section 42 can be set to a more appropriate value. Therefore, the combustion efficiency can further be enhanced. A distance D3 between the center electrode 10 and the bent portion 45 of the auxiliary grounding electrode 30 is larger than the distance D2 between the center electrode 10 and the end of the auxiliary grounding electrode 30. Therefore, discharge spark is not generated between the bent portion 43 and the center electrode 10.

Figure 3:
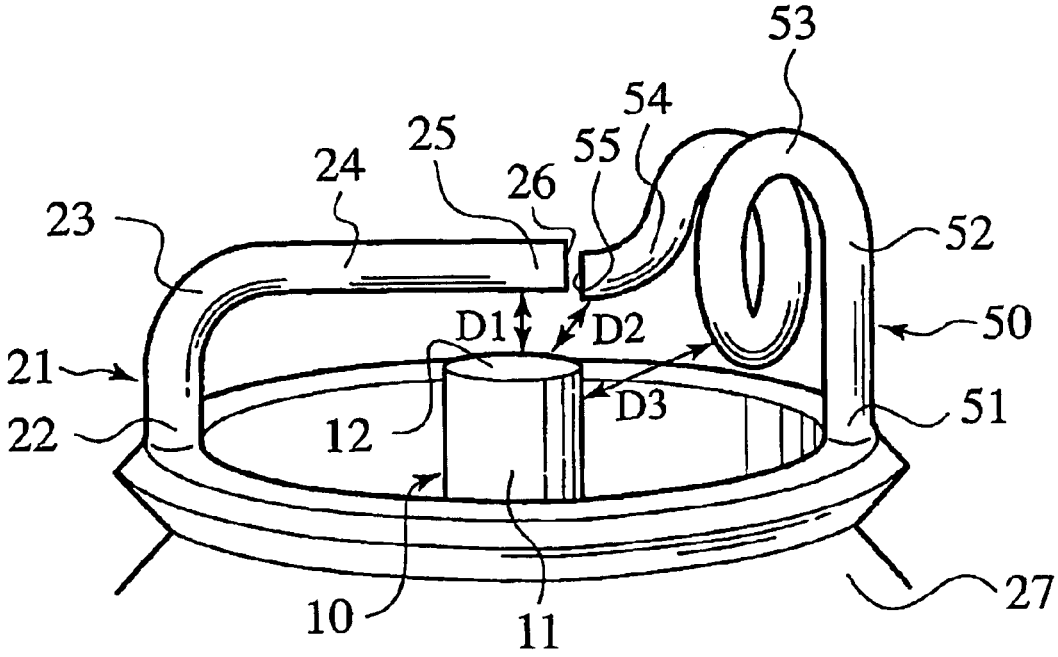
FIG. 3 is a diagram showing an electrode portion of a third embodiment when an ignition system for an internal combustion engine according to the present invention is applied to a spark plug.

A third embodiment shown in FIG. 3 is also largely different from the first embodiment shown in FIG. 1 that a shape of the inductor section provided in the auxiliary grounding electrode is different.

According to a spark plug of the third embodiment, an inductor section 52 of an auxiliary grounding electrode 50 is formed into a coil-like shape, thereby reducing the inductor section 52 in size, and a reactance of the inductor section 52 can be set to a more appropriate value. The combustion efficiency can further be enhanced.

Figure 4:
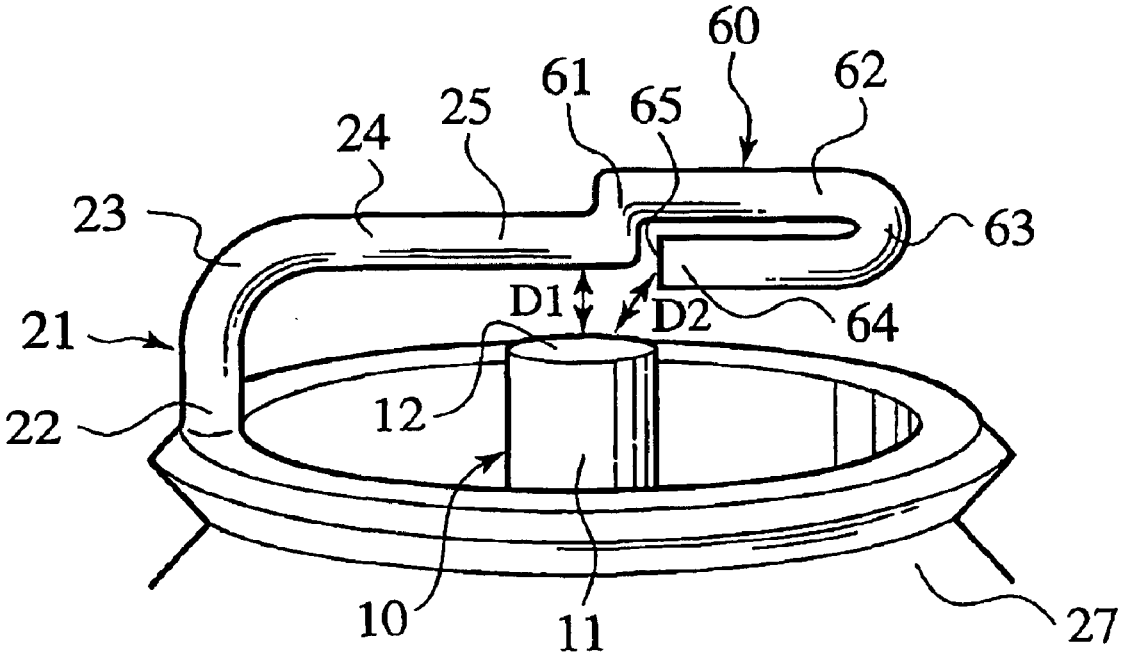
FIG. 4 is a diagram showing an electrode portion of a fourth embodiment when an ignition system for an internal combustion engine according to the present invention is applied to a spark plug.

A fourth embodiment shown in FIG. 4 is largely different from the first embodiment shown in FIG. 1 that an auxiliary grounding electrode 60 is disposed on an end of the main grounding electrode 21 through a connection portion 61. Since the auxiliary grounding electrode 60 is disposed on the end of the main grounding electrode 21, machinability of the electrode when the electrode is produced is facilitated, and a reactance of the inductor section 52 can be set to a more appropriate value.

According to this embodiment, flowability of mixture gas around the discharge region is high, and even with low load driving state or lean burn engine, it is possible to keep the fuel mixture concentration in discharge region high and thus, the ignition efficiency can be enhanced.

Figure 6:
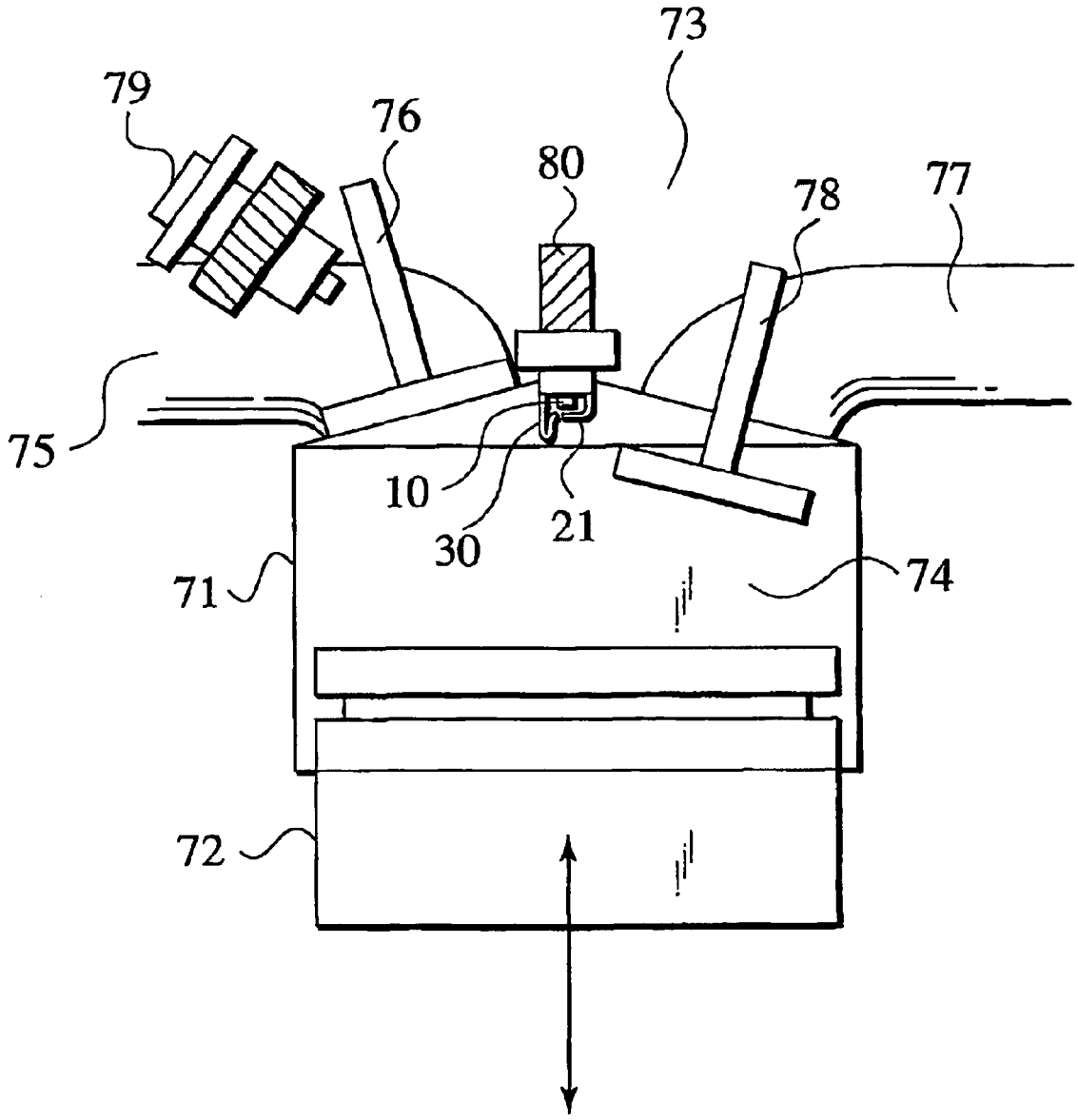
FIG. 6 is a diagram showing a combustion chamber having the first embodiment of the ignition system for the internal combustion engine according to the present invention.

FIG. 6 is a diagram showing a combustion chamber of four-cycle engine having the first embodiment of the ignition system for the internal combustion engine of the present invention. A reference number 71 represents a cylinder block, a reference number 72 represents a piston, a reference number 73 represents a cylinder head, a reference number 74 represents a combustion chamber formed by the cylinder block 71, the piston 72 and the cylinder head 73.

The cylinder head 73 is provided with an intake valve 76 which opens and closes an intake port 75, and a discharge valve 78 which opens and closes an exhaust port 77.

A fuel injection valve 79 which injects gasoline fuel is provided in the intake port 75, and a spark plug 80 having an electrode structure shown in FIG. 1 is disposed on a center portion of the combustion chamber 74.

In an intake stroke, the piston 72 is lowered, the intake valve 76 is opened, and air is charged into the combustion chamber 74 through the intake port 75. At that time, a determined amount of fuel is injected from the fuel injection valve 79 and mixture gas of air and fuel is charged into the combustion chamber 74.

If the mixture gas is charged into the combustion chamber 74, the intake valve 76 is closed, the piston 72 start moving upward, and the stroke is changed into compression stroke. If the piston 72 reaches top dead center, secondary voltage of the ignition coil (not shown) is applied to the spark plug 80, and the discharge is started between the center electrode 10 and the grounding electrode 20.

If the discharge is started between the center electrode 10 and the grounding electrode 20, most of the secondary voltage is distributed to the auxiliary grounding electrode 30 by the impedance Z of the inductor section 32 provided in the auxiliary grounding electrode 30. As a result, the discharge between the center electrode 10 and the auxiliary grounding electrode 30 is completed in a short time because the rate of secondary voltage distributed to the gap portion is decreased. With this, molecule of mixture gas in the combustion chamber is excited.

Since the main grounding electrode 21 does not have inductor section, reactance thereof is low, and distribution ratio of secondary voltage by the impedance is small. As a result, the discharge between the main grounding electrode 21 and the center electrode is continued until the secondary voltage becomes sufficiently small. Since the discharge duration becomes long and excited mixture gas molecule is ignited, the combustion state is stabilized, and combustion efficiency is also enhanced.

With this, there is effect that the accidental fire is prevented, fuel consumption rate is enhanced, engine output is enhanced, and hydrocarbon compounds in exhaust gas are reduced.

Since it is possible to dispose the present invention in the electrode of the spark plug, the present invention can be applied not only to a newly developed internal combustion engine but also to an already commercially available internal combustion engine only by replacing the spark plug. Therefore, the ignition system for the internal combustion engine has extremely high general-purpose use.

The above-explained embodiments are for making it easy to understand the present invention, and the invention is not limited to these embodiments. Therefore, each element indicated in the embodiments includes all of design optional items, which belong to technical range of the present invention.

For example, although the inductor section is provided by folding the electrode in the fourth embodiment, the electrode may be of coil-like shape.

In FIG. 6, the present invention is applied to the spark plug used for the four-cycle engine, but the same effect is obtained even if the invention is applied to a spark plug used in a two-cycle engine.

That is, the present invention is not limited to the embodiments only if the following system is designed, or includes an ignition method. The system is designed such that if the auxiliary grounding electrode includes a function of an inductor, when high voltage pulse is applied to the electrode and an auxiliary discharge is carried out by the auxiliary grounding electrode, counterelectromotive force is generated in the auxiliary grounding electrode, the auxiliary discharge is completed in a short time, thereby exciting the gas molecule of mixture gas in the combustion chamber, and the excited gas molecule of mixture gas is ignited by the main discharge by the main grounding electrode. The system includes an ignition method that the high voltage pulse is applied to the electrode, and when the auxiliary discharge is carried by the auxiliary grounding electrode, the counterelectromotive force is generated by the auxiliary grounding electrode, the auxiliary discharge is completed in a short time, thereby exciting the gas molecule of mixture gas in the combustion chamber, and the excited gas molecule of mixture gas is ignited by the main discharge by the main grounding electrode.

INDUSTRIAL APPLICABILITY

According to the first aspect of the ignition system for the internal combustion engine of the present invention, since the auxiliary grounding electrode includes a function of an inductor, if high voltage pulse is applied to the electrode and the auxiliary grounding electrode is allowed to carry out the auxiliary discharge, the counterelectromotive force is generated in the inductor section of the auxiliary grounding electrode. Thus, the auxiliary discharge is completed in a short time. With this, the mixture gas in the combustion chamber is not ignited but the gas molecule of mixture gas can be excited. With this, there is effect that main discharge by the main grounding electrode ignites the gas molecule of excited mixture gas, ignition is reliably carried out, the combustion efficiency is enhanced, accidental fire is prevented, fuel consumption ratio is enhanced, engine output is enhanced, hydrocarbon compounds in exhaust gas are reduced.

Further, since the present invention can be disposed only by machining of the electrode of the spark plug, the system can easily be produced, and the invention shows high general purpose of use that the effect can be obtained only by replacing a spark plug used not only in a newly developed internal combustion engine but also in an already commercially available internal combustion engine with the spark plug having the present invention.

The operation such as replacement and repair carried out over long term use or deterioration with time, and adjustment of the inductor section can be carried out only by replacing the spark plug, there is effect that the operability of replacement and repair is excellent, and operation cost is low.

According to the second aspect of the ignition system for the internal combustion engine of the invention, in addition to the effect of the first aspect, it is possible to set the reactance of the inductor section to an appropriate value by increasing the number of folded portions of the inductor section, and there is effect that the combustion efficiency can further be enhanced.

According to the third aspect of the ignition system for the internal combustion engine of the invention, in addition to the effect of the first aspect, since the inductor section is of helical shape, it is possible to set the reactance of the inductor section to an appropriate value, and there is effect that the combustion efficiency can further be enhanced.

According to the fourth aspect of the ignition system for the internal combustion engine of the invention, in addition to the effect of the first aspect, since the auxiliary grounding electrode is extended to the end of the main grounding electrode, there is effect that it is possible to enhance the combustion efficiency further, and the machinability at the time of production becomes easy.

According to the fifth aspect of the ignition system for the internal combustion engine of the invention, in addition to the effect of the first aspect, since the distance between the auxiliary grounding electrode and the center electrode is narrower than the distance between the main grounding electrode and the center electrode, there is effect that the auxiliary discharge can be carried out before the main discharge more reliably.

According to the sixth aspect of the ignition system for the internal combustion engine of the invention, in addition to the effect of the first aspect, a plurality of auxiliary grounding electrodes are provided for one main grounding electrode, there is effect that the exciting state of the mixture gas molecule is further enhanced by the auxiliary discharge.

According to the seventh aspect of the ignition system for the internal combustion engine of the invention, in addition to the effect of the first aspect, since the plurality of electrodes are provided, there is effect that the mixture gas can be brought into the excited state by the auxiliary discharge for the internal combustion engine having large combustion chamber, and the mixture gas can be burned completely by the main discharge.

According to the eighth aspect of the ignition system for the internal combustion engine of the invention, in addition to the effect of the first aspect, since the mixture gas molecule is excited by the auxiliary discharge and the mixture gas excited by the main discharge can be ignited, there is effect that the ignition is reliably carried out, and the combustion efficiency can be enhanced.

What is claimed is:

1. An ignition system for an internal combustion engine comprising:

a grounding electrode electrically grounded;

a center electrode to which high voltage pulse is applied;

a main grounding electrode provided in the grounding electrode;

an auxiliary grounding electrode provided in the grounding electrode; and an inductor section provided in the auxiliary grounding electrode, wherein an end of the main grounding electrode and an end of the auxiliary grounding electrode are disposed close to the end of the center electrode; and wherein the inductor section is integrally provided between a portion branched from the grounding electrode and the end of the auxiliary grounding electrode.

2. An ignition system for an internal combustion engine according to claim 1;

wherein the auxiliary grounding electrode is a bar-like bent portion that the inductor section is provided between the end of the auxiliary grounding electrode and the grounding electrode.

3. An ignition system for an internal combustion engine according to claim 1;

wherein the inductor section is a helical bent portion.

4. An ignition system for an internal combustion engine according to claim 1;

wherein the auxiliary grounding electrode is extended from the end of the main grounding electrode.

5. An ignition system for an internal combustion engine according to claim 1;

wherein a distance between the auxiliary grounding electrode and the center electrode is narrower than a distance between the main grounding electrode and the center electrode.

6. An ignition system for an internal combustion engine according to claim 1;

wherein for the single center electrode, the grounding electrode is branched into the single main grounding electrode and a plurality of the auxiliary grounding electrodes.

7. An ignition system for an internal combustion engine according to claim 1, further comprising a plurality of sets of opposed the grounding electrodes and the center electrodes.

8. An ignition method of fuel charged in a fuel chamber, comprising the steps of:

charging fuel and air into a combustion chamber;

feeding high voltage pulse to a center electrode;

carrying out auxiliary discharge between an auxiliary grounding electrode and the center electrode to excite mixture gas of fuel and air in the combustion chamber; and carrying out main discharge between a main grounding electrode and the center electrode to ignite the mixture gas.

* * * * *